US009586424B2

(12) United States Patent
Campbell et al.

(10) Patent No.: US 9,586,424 B2
(45) Date of Patent: Mar. 7, 2017

(54) PRINTHEAD ATTACHMENT SYSTEM

(71) Applicant: Inca Digital Printers Limited, Cambridge (GB)

(72) Inventors: Nicholas John Campbell, Cambridge (GB); Steven Mark Sadler, Cambridge (GB)

(73) Assignee: Inca Digital Printers Limited (GB)

( * ) Notice: Subject to any disclaimer, the term of this patent is extended or adjusted under 35 U.S.C. 154(b) by 30 days.

(21) Appl. No.: 14/812,575

(22) Filed: Jul. 29, 2015

(65) Prior Publication Data

US 2016/0031238 A1 Feb. 4, 2016

(30) Foreign Application Priority Data

Jul. 30, 2014 (GB) ..... 1413468.8

(51) Int. Cl.

| | |
|---|---|
| ***B41J 25/00*** | (2006.01) |
| ***B41J 2/21*** | (2006.01) |
| ***B41J 25/34*** | (2006.01) |

(52) U.S. Cl.

CPC ..... *B41J 25/001* (2013.01); *B41J 2/2146* (2013.01); *B41J 25/003* (2013.01); *B41J 25/34* (2013.01); *B41J 2202/19* (2013.01); *B41J 2202/21* (2013.01)

(58) Field of Classification Search

CPC ..... B41J 25/001; B41J 25/003

See application file for complete search history.

(56) References Cited

U.S. PATENT DOCUMENTS

| | | | |
|---|---|---|---|
| 4,570,168 | A | 2/1986 | Sjordal et al. |
| 4,657,417 | A | 4/1987 | Kikuchi et al. |
| 2002/0191049 | A1 | 12/2002 | Silverbrook |
| 2006/0077225 | A1 | 4/2006 | Song et al. |

(Continued)

FOREIGN PATENT DOCUMENTS

| | | | |
|---|---|---|---|
| DE | 102010060412 | A1 | 5/2012 |
| WO | 9932301 | A1 | 7/1999 |
| WO | 2011098646 | A1 | 8/2011 |

OTHER PUBLICATIONS

United Kingdom Search Report for Application No. GB1413468.8 dated Jan. 29, 2015.

(Continued)

*Primary Examiner* — Kristal Feggins
*Assistant Examiner* — Kendrick Liu
(74) *Attorney, Agent, or Firm* — Lerner, David, Littenberg, Krumholz & Mentlik, LLP

(57) ABSTRACT

A printhead support structure may have a receiving portion to receive a printhead, first and second portions having an adjustment mechanism therebetween for converting a translational movement of the first portion to a rotational movement of the second portion, and a coupling mechanism coupling the second portion to the receiving portion for adjusting the rotational angle of the printhead. A method for adjusting a position of a printhead coupled to a printhead support may include applying a force to a first portion of the printhead support to effect a translational movement of the first portion, converting the translational movement of the first portion into a rotational movement of a second portion of the printhead support, and applying the rotational movement of the second portion to the printhead.

18 Claims, 11 Drawing Sheets

(56) References Cited

U.S. PATENT DOCUMENTS

| | | | | |
|---|---|---|---|---|
| 2009/0147048 | A1 | 6/2009 | Zhao et al. | |
| 2010/0182382 | A1* | 7/2010 | Lee | B41J 2/145 347/68 |
| 2011/0074877 | A1 | 3/2011 | Shinoda | |
| 2013/0093816 | A1 | 4/2013 | Balsells Mercad et al. | |

OTHER PUBLICATIONS

European Search Report for Application No. EP 15178365 dated Nov. 27, 2015.

* cited by examiner

PRINTHEAD ATTACHMENT SYSTEM

CROSS-REFERENCE TO RELATED APPLICATION

This application claims priority from United Kingdom Patent application Serial No. GB1413468.8 filed Jul. 30, 2014, the disclosure of which is incorporated herein by reference.

BACKGROUND OF THE INVENTION

The subject matter of the disclosure relates to a printhead support structure and a print assembly permitting movement or positional adjustment of a printhead, and a method of adjusting a position of a printhead coupled to a printhead support.

Printers are well-known devices for applying text and graphic images to a variety of substrates. A wide variety of different printers are available which are suitable for printing onto different types and sizes of substrate.

Large-scale industrial printers are adapted to print images onto larger substrates than, for example, office-based printers used for printing onto A4-size paper. Large-scale printers may be used for printing onto, for example, advertising boards, posters, and/or large batches of smaller substrates.

In an inkjet printing process, a series of droplets of, for example, ink is deposited onto the surface of a substrate in a pattern to form the required image. The droplets of ink are typically emitted from nozzles on an inkjet printhead. A typical printer includes several printheads arranged along a print carriage. The print carriage can be up to around 2 m in width. Printer manufacturers aim to provide a dense and continuous array of printheads across the whole width of the print carriage. Usually these are provided in multiple rows to give a 2-D array of printheads.

Recent advances in inkjet printhead manufacture have allowed manufacturers to integrate several thousand inkjet nozzles on a single printhead: this is frequently achieved by arranging the nozzles in a two-dimensional grid pattern, as illustrated schematically in FIG. 1.

In order to achieve good positional registration (i.e. relative positioning) between nozzles within a printhead, the correct azimuthal rotation of the printhead should be established. This is illustrated in FIG. 1, which shows lines of ink 20*a*, 20*b*, 20*c* laid down by printhead nozzles 10*a*, 10*b*, 10*c*. When the printhead is correctly rotationally aligned, the lines of ink 20*a*, 20*b*, 20*c* laid down by the nozzles 10*a*, 10*b*, 10*c* are equally spaced. However, if the array of nozzles 10*a*', 10*b*', 10*c*' is rotated and incorrectly rotationally aligned, the printed lines of ink 20*a*', 20*b*', 20*c*' are no longer equally spaced.

In addition to the azimuthal rotation of the printhead, translational alignment in the print direction ("along-process" direction i.e. in the direction the print carriage moves in relation to the substrate) and perpendicular to the print direction ("cross-process" direction i.e. across the width of the print carriage) should also be considered. In order to maintain the equal spacing of the printed lines of ink at the boundaries between printheads, there should also be good registration between printheads in the cross-process direction.

Along-process registration may be achieved by altering the firing times of the individual printheads, as is illustrated in FIG. 2, and vertical positioning and other rotations can be set adequately by manufacturing tolerances. FIG. 2 shows the nozzles of a first printhead 1 and a second printhead 2, which are not aligned in the along-process direction. Registration between these can be achieved by delaying the firing time of printhead 2 compared to printhead 1, so that both arrays of nozzles lay down ink in the same place on the substrate.

However, as printheads with higher resolutions and smaller drop sizes are developed, azimuthal and cross-process positioning are difficult to achieve using standard manufacturing tolerances so some degree of mechanical adjustment can be used to enable alignment of the printheads within the print carriage.

Printheads are usually manufactured individually and fixed to a print carriage, on which they are aligned. Some printheads are modular, with every printhead individually replaceable in the field, requiring them to be individually adjustable for alignment. While technically challenging, this can provide improvements in the accuracy of alignment, because there is no stack up of tolerances, and because the final adjustment is done with the head in its operating condition. This also means that the final printed position of droplets is used for alignment, rather than nozzle position, so it includes any systematic jet deviations. A typical print carriage may have around 150 printheads, and the initial aligning and maintaining the alignment of that number of printheads is quite a demanding task.

Further, when building large arrays of printheads, it is desirable to make the assembly as compact as is reasonably possible, as this improves the registration between printheads both within and between colours. However, this also means it is more difficult to make adjustments.

Aspects of the invention are set out in the independent claims and preferred features are set out in the dependent claims.

There is described herein a printhead support structure, comprising: means for receiving a printhead; first and second portions having adjustment means therebetween for converting a translational movement of the first portion to a rotational movement of the second portion; and means for coupling the second portion to said receiving means for adjusting the rotational angle of the printhead.

By providing a printhead support structure that can use a translational actuation to provide a rotational adjustment of the printhead, a printhead can be rotationally aligned after installation, even in a tightly packed array where space restrictions can make it difficult to provide a rotational actuation to individual printheads. Advantageously, it is easier to achieve good alignment when the printhead is adjusted in its operating position, since it is possible to compensate for discrepancies in the manufacture of other components in a printer, such as the support structure, print carriage and/or print table.

Preferably, the first portion is coupled to a print carriage and constrained to move substantially along a first axis; and the second portion is fixed at an edge, such that the second portion is constrained to rotate about a second axis parallel to the first axis.

Preferably, the second portion is fixed at the edge by means of a flexure.

Using a flexure to fix the second portion is advantageous because flexures are very stable and resilient to thermal changes and vibration. They do not exhibit "slop" or "backlash" and do not require locking. Additionally, it is possible to cut flexures out of the existing printhead support structure, so no further parts or material is required.

Preferably, the adjustment means is arranged such that a translational movement of the first portion along a first axis produces a force on or causes a force to be applied to the second portion in a direction perpendicular to the first axis, such that said force causes the second portion to rotate about a second axis parallel to the first axis.

By arranging the adjustment means in this way, the translational movement of the first portion substantially along the first axis transfers a force to the second portion to cause movement of an edge of the second portion in a direction substantially perpendicular to the first portion. When an opposing edge of the second portion is fixed, this causes the second portion to rotate about this fixed edge.

Preferably, the second portion is coupled to the printhead such that the rotational movement of the second portion about a second axis provides a rotational movement of the printhead about an axis parallel to the second axis.

Preferably, the adjustment means comprises a flexure arrangement.

By using a flexure arrangement for the adjustment means, it is possible to reduce the frequency with which printheads need to be realigned because flexures are very resilient to thermal changes and vibration. It has been unexpectedly found that such a flexure arrangement is very stable and so frequent readjustment does not seem to be required. Additionally, the use of a flexure means locking is not required, since flexures do not have backlash or slop, unlike, for example, sliding hinges.

Preferably, the flexure arrangement comprises two or more flexures.

By using two or more flexures, the translational movement in the first direction can cause the adjustment means to bend at these two flexure points, and hence produce a force in a perpendicular direction.

Preferably, the flexure arrangement is formed within the body of the printhead support structure.

By forming the flexure arrangement from the body of the printhead support, in particular by removing parts of the structure to form flexures, the adjustment mechanism does not require any extra space in the print carriage or any additional material and so the solution can be implemented cost-effectively and it is possible to place the printheads in a tightly packed array and to keep the print carriage fairly compact.

Preferably, the flexure arrangement comprises a pair of opposed flexure points with a diagonal linkage.

By providing a diagonal linkage between two opposed flexure points, it is possible to use a geometrical reduction to convert a relatively large translational movement into a finer/smaller rotational movement.

Preferably, the printhead support structure retains the printhead in a fixed position after adjustment without an additional locking mechanism.

By providing a printhead adjustment structure which does not require locking to keep a printhead in place, a more precise adjustment can be made because locking normally produces some movement, which changes the alignment made during the adjustment stage. It is necessary to compensate for any change due to locking when making the adjustment, prior to locking. Therefore, several attempts (e.g. "trial and error") may need to be made before the correct adjustment is found. Such multiple attempts in adjustment are not necessary when locking is not required. Adjustments that do not require locking are also easier to automate.

Preferably, the second portion is fixed at a first edge, such that a second edge of the second portion, opposed to the first edge, is constrained to rotate about the first edge. The rotational movement of the second edge has a component perpendicular to the plane of the second portion and the adjustment means is arranged to provide a reduction ratio such that the magnitude of this component of movement of the second edge of the second portion and the magnitude of the translational movement of the first portion are in a ratio of less than one. The component of movement of the second edge that is perpendicular to the plane of the second portion may be termed herein the translational movement of the second portion.

Preferably, the adjustment means is arranged to provide a reduction ratio such that the rotational movement of the second portion and the translational movement of the first portion are in a ratio of less than one.

By arranging the adjustment means such that the rotational movement, or the magnitude of the translational movement caused by the rotation of the opposing or outer edge of the second portion is smaller than that of the translational movement of the first portion, very small, accurate adjustments can be made to the alignment of the printhead. Additionally, any forces on the printhead will only produce relatively small forces at the adjustment mechanism, which enables the adjustment to be much more stable during use and removes the need for frequent readjustment or locking. Furthermore, by providing a reduction ratio in the adjustment, any small movement of the printhead adjustment elements (i.e. the first portion, screws, pivots), caused by vibration, changing loads or thermal cycling during printer operation would only be transferred to the printhead in a ratio of less than one.

Preferably, the printhead support structure further comprises an adjuster screw arranged such that rotation of the adjuster screw provides said translational movement of the first portion.

By providing a screw for actuating printhead adjustment, the accuracy of adjustments can be improved because a relatively large rotation of the screw produces a smaller translational movement of the screw. Additionally, the screw can stay fixed in place once an adjustment has been made without the requirement for locking, for example due to the friction created by the thread of a screw. Furthermore, it is easy to automate the actuation of a screw, for example by using a motor.

Preferably, the printhead adjustment is actuated from a direction parallel to the axis of rotation of the printhead.

When printheads are closely packed in a large array, it is much easier to access each printhead from above or below the plane of the printhead array than from a direction adjacent to the printhead. Therefore, it is advantageous to be able to actuate a rotation in the plane of the printhead from a direction parallel to the axis of rotation.

Preferably, the printhead has an array of a plurality of nozzles and the rotational movement of the printhead is in the plane of the array of nozzles.

By rotating a printhead in the plane of the nozzle array, the correct azimuthal rotation of the printhead can be found to ensure that lines of ink laid down by the nozzles are equally spaced.

Preferably, the mechanism is further operable to provide a translational movement of the printhead.

By providing a mechanism which can provide a translational movement to the printhead, it is possible to adjust the position of printheads relative to other printheads within a printhead array and/or relative to the print carriage. Such adjustments can be helpful to achieve correct relative positioning of the nozzles between printheads.

Preferably, the translational movement provided to the printhead is in the cross-process direction.

By providing a translational adjustment to the printhead in the cross-process direction, the spacing between lines of ink laid down by nozzles on adjacent printheads can be adjusted. This can help to ensure consistent density of ink across the width of the substrate (i.e. perpendicular to the print direction).

Preferably, the printhead support structure further comprises a third portion coupled to the printhead such that a translational movement of the third portion provides said translational movement of the printhead.

Preferably, the translational movement of the printhead compensates for an alteration in the translational position of the printhead effected by said adjusting of the rotational angle of the printhead.

By providing means for compensating for the translation caused by rotational movement in the printhead support which provides the rotational movement, correct complete alignment of the printhead can be achieved in a single set of adjustments.

Preferably, the translational movement of the printhead alters the effective axis of rotation of the printhead.

The desired printhead rotation may be about an axis that is different from the axis the second portion causes the printhead to rotate about. Therefore, in order to achieve the desired printhead adjustment, it may be necessary to provide an additional translational movement.

Preferably, the printhead support structure further comprises a translational motor for effecting translational movement of the third portion.

Preferably, the printhead support structure further comprises a translational adjuster screw arranged such that rotation of the adjuster screw provides translational movement parallel to the direction of the axis of rotation of the printhead; and wherein the adjuster screw is in communication with the third portion, such that the translational movement provided by the screw is transferred to the third portion.

Preferably, the translational motor is in communication with the translational adjuster screw and wherein the translational motor is operable to rotate the translational adjuster screw.

Preferably, the printhead support structure further comprises a motor for effecting translational movement of the first portion.

By providing motors for actuating/driving the adjustment mechanism, it is possible to automate the adjustment of printhead alignment, optionally from a distance or over a network. This can be more efficient, accurate and less error prone than performing adjustment manually (i.e. by a human operator physically adjusting the alignment). In addition, when printheads are closely packed within an array, it may be difficult for human operators to access the adjustment mechanism, and easier for a motor to operate in confined spaces.

Preferably, the motor is in communication with the adjuster screw and the motor is operable to rotate the adjuster screw.

By providing motors for rotating an adjuster screw, the amount the screw is rotated can be carefully controlled, in particular, to a greater degree of precision than when screws are rotated manually. For example, a stepper motor can be used, which provides rotation in steps of uniform, predetermined amounts (e.g. 1.8°).

There is further described herein a print assembly comprising an array of a plurality of printheads arranged in a plane; and a printhead support structure as described above for each of said plurality of printheads for adjusting the position of each printhead; wherein each printhead adjustment is actuated from a direction perpendicular to the plane of the printhead array.

By allowing printheads to be adjusted from above or below, the adjustment can be performed after printheads have been installed in a closely packed array. It is advantageous to have a large number of printheads in a closely packed array, as this leads to better print resolution, an improved registration between printheads both within and between colours or arrays and faster printing, but when closely packed, individual printheads cannot be accessed from within the plane of the array. By allowing adjustment of printheads after installation, the printheads can be individually replaced and then adjusted, which saves costs, rather than having to replace an entire array of printheads, which would need to be aligned prior to installation. Furthermore, printhead alignment can be adjusted to correct for alignment errors that occur during use of the printer after installation. Additionally, it is possible to adjust printhead alignment to correct for discrepancies in printer elements within standard manufacturing tolerances.

Preferably, the rotational movement of the printhead is in the plane of the printhead array.

There is also described herein a method for adjusting the position of a printhead coupled to a printhead support, comprising the steps of: applying a force to a first portion of the printhead support to effect a translational movement of the first portion; converting said translational movement of the first portion into a rotational movement of a second portion of the printhead support; and applying said rotational movement of the second portion to the printhead.

Advantages of this aspect and the optional features set out below correspond to those for the aspects already described above.

Preferably, the translational movement is provided substantially along a first axis; and the rotational movement is substantially about an axis parallel to the first axis.

Preferably, the method for adjusting the position of a printhead further comprises the step of receiving the printhead on the printhead support.

Preferably, the converting of translational movement to rotational movement is accomplished by means of a flexure arrangement.

Preferably, the method for adjusting the position of a printhead further comprises the step of: retaining the printhead in a fixed position after applying said rotational movement to the printhead without locking.

Preferably, the magnitude of the movement of an outside edge of the second portion and the magnitude of said translational movement of the first portion are in a ratio of less than one.

Preferably, the printhead comprises an array of a plurality of nozzles and the rotational movement of the printhead is in the plane of the array of nozzles.

Preferably, the method for adjusting the position of a printhead further comprises the step of: providing a translational movement of the printhead in a cross-process direction.

Preferably, the method for adjusting the position of a printhead further comprises the step of: calculating said translational movement of the printhead in the cross-process direction is calculated to compensate for the rotational movement applied to the printhead.

Preferably, the compensation for the rotational movement alters the effective axis of rotation of the printhead.

There is also described herein a method of manufacturing a printhead adjustment mechanism, comprising the steps of:

providing a printhead support structure, the printhead support structure comprising means for receiving a printhead; and removing selected parts of the printhead support structure to form first and second portions and an adjustment means therein for converting a translational movement of a first portion of the printhead support structure to a rotational movement of a second portion of the printhead support structure; wherein the adjustment means is coupled to the receiving means so that rotational movement of the second portion effects the rotational angle of the printhead.

By removing selected parts of the printhead support structure to manufacture the printhead adjustment mechanism, the adjustment mechanism can be made very compact. This allows printheads to be closely packed together within and between arrays, which is advantageous because this leads to better print resolution, an improved resolution between printheads both within and between colours or arrays and faster printing.

Preferably, removing selected parts of the printhead support structure comprises removing a first segment of the printhead support structure to create a recess forming a first flexure point; and removing a second segment of the printhead support structure to create a recess forming a second flexure point; wherein said flexure points are arranged to convert translational movement of the first portion into rotational movement of the second portion.

Preferably, the two flexure points are arranged in a diagonal linkage.

Preferably, removal of the segments is performed by wire erosion or by cutting with a plunge cutter.

Preferably, the method of manufacturing a printhead adjustment mechanism, further comprises the step of removing a third section of the printhead support structure to create a third flexure point, wherein said third flexure point creates a flexure hinge arrangement for securing a printhead to the printhead support structure.

By creating a flexure hinge for clamping the printhead to the support structure, it is possible to attach the printhead securely to the support, without providing an additional locking mechanism, which would take up space in the printhead support structure and provide additional complexity to the system. Furthermore, it simplifies the manufacturing method, particularly if flexures are already being used in other parts of the printhead support structure, which means it is not necessary to provide separate equipment and/or processes for installing a different type of clamping mechanism in the printhead support.

There is also described herein a print assembly comprising: an array of a plurality of printheads arranged in a plane; and an adjustment mechanism for each printhead for providing a rotational adjustment about an axis perpendicular to the plane for adjusting the rotational alignment of each printhead; wherein the rotational adjustment is effected from a direction substantially parallel to the axis of the rotational adjustment.

When printheads are arranged in a closely packed array, it is difficult to access each printhead individually, and it is easiest and most efficient to access the printhead adjustment mechanisms from above or below the plane of the printhead array.

Preferably, a further translational adjustment is effected from the direction substantially parallel to the axis of the rotational adjustment.

There is also described herein a method for adjusting printhead alignment, comprising the steps of: determining the required printhead rotational adjustment; using said required printhead rotational adjustment to calculate the magnitude of a rotational correction required to perform said rotational printhead alignment; calculating the translational movement of the printhead which results from said correction required to perform said rotational printhead alignment; determining the required printhead translational adjustment in the cross-process direction; calculating the magnitude of a translational correction required to perform said translational printhead adjustment; wherein determining the required translational printhead adjustment comprises compensating for the calculated translational movement of the printhead which results from said correction required to perform said rotational printhead alignment; and applying said rotational and translational corrections to adjust the printhead.

By calculating the rotational adjustment required for a printhead and the translational movement which would result from it, and applying calculated rotational and translational corrections to the printhead, it is possible to achieve correct, or at least sufficiently accurate, printhead alignment in relatively few steps, since it negates the need to compensate through trial and error.

Preferably, said rotational and translational corrections are automated.

By automating the actuation of corrections, it is possible to perform quicker and more accurate printhead alignment than when adjustment is attempted manually.

Preferably, the method for adjusting printhead alignment further comprises calculating a compensation for along-process errors in printhead alignment.

By calculating a compensation for along-process errors, it is possible to ensure correct registration between printheads, and therefore that ink is laid down correctly on the substrate.

Preferably, compensating for along-process errors in printhead alignment comprises altering the firing times of neighbouring printheads Preferably, calculating the required corrections comprises calculating the magnitude of the required movement of one or more printhead support portions.

Preferably, calculating the magnitude of the required movement of one or more printhead support portions further comprises calculating the required rotation of one or more adjustment screws.

Preferably, calculating the magnitude of the required movement of one or more printhead adjustment portions further comprises calculating the required steps to be performed by one or more motors.

Preferably, the method for adjusting printhead alignment is performed by a computer program.

Using these apparatus and methods, it has been found that the mechanical adjustments, and hence the registration of the printheads, can be made to resolutions of a few microns and are stable at that level, which achieves a good print quality.

BRIEF DESCRIPTION OF THE DRAWINGS

Embodiments will now be described, by way of example only and with reference to the accompanying drawings, in which.

DETAILED DESCRIPTION OF THE INVENTION

Figure 9:
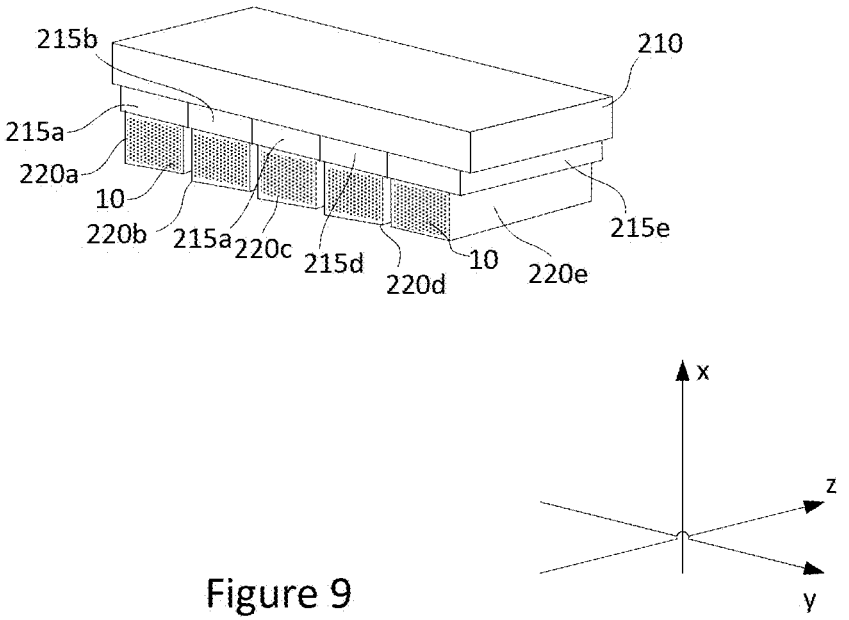
FIG. 9 illustrates a schematic diagram of a print carriage.

FIG. 9 shows a schematic diagram of a print carriage 210. The print carriage 210 comprises printhead supports, to secure printheads to the print carriage and enable position adjustment of the printheads. In this schematic example, there are five printheads 220(*a-e*) attached to the print carriage 210, but there would typically be many more printheads attached to a print carriage, typically 50, 100 or even more printheads. Each printhead 220(*a-e*) has an array of nozzles 10. Printhead support portions 215(*a-e*) are also shown for each printhead 220(*a-e*). A set of conventional, right-hand orthogonal axes is shown. The nozzles 10 of the printheads 220(*a-e*) form an array in the x-y plane. In this example, the along-process direction is parallel to the x-axis, and the cross-process direction is parallel to the y-axis. The attachment of the printheads 220(*a-e*) to the printhead supports 215(*a-e*) may be accomplished, for example, by being clamped between portions of the printhead supports 215(*a-e*), by being screwed or bolted to the printhead support 215(*a-e*) material etc. The printheads 220(*a-e*) are individually replaceable and can be fitted separately.

One way to releasably secure printheads to the printhead support structure, so that they can be easily removed individually is to provide one or more slides in the printhead support structure for engaging each printhead, e.g. dovetail slides. The printhead support structure includes a cavity for receiving part of the printhead, and the one or more sides may be provided on one or both edges of the cavity. When the printhead is inserted into the cavity, the printhead engages with the slide. When fully inserted, the printhead may then be secured. It is advantageous to provide a mechanism for securing the printhead automatically (e.g. a clamp arrangement or a latch), without the need for actuation, once the printhead has been fully inserted. Such securing means may, for example, comprise a spring-loaded clamp or a clamp comprising a flexure arrangement formed by cutting out portions of the printhead support, which provides sufficient force against the printhead body to secure the printhead within the printhead support portion. Normally the release of the printhead would have to be actuated, for example by depressing the spring to unclamp the printhead.

Once a printhead 220(*a-e*) has been fitted, it is advantageous to adjust its alignment. This could be, for example, to compensate for manufacturing tolerances in the printheads 220(*a-e*), in the print carriage 210, or in the way the print carriage 210 is aligned with an entire printer assembly. Adjustment may also be necessary to compensate for misalignment created when the printhead is attached to the printhead support 215(*a-e*). Printheads are often tightly packed, which makes it difficult to access and adjust each individual printhead, except through an axis perpendicular to the plane of the nozzle array. Adjustment can be achieved by using printhead adjustment mechanisms within the printhead supports 215(*a-e*), which will be described in more detail below.

In one adjustment, the printhead may need to be moved translationally, e.g. to adjust the cross-process alignment of printheads, i.e. requiring an adjustment in the y-direction. Advantageously, this should be done by applying an adjustment vertically through the plane of the nozzle array (from behind the printhead).

Figure 3:
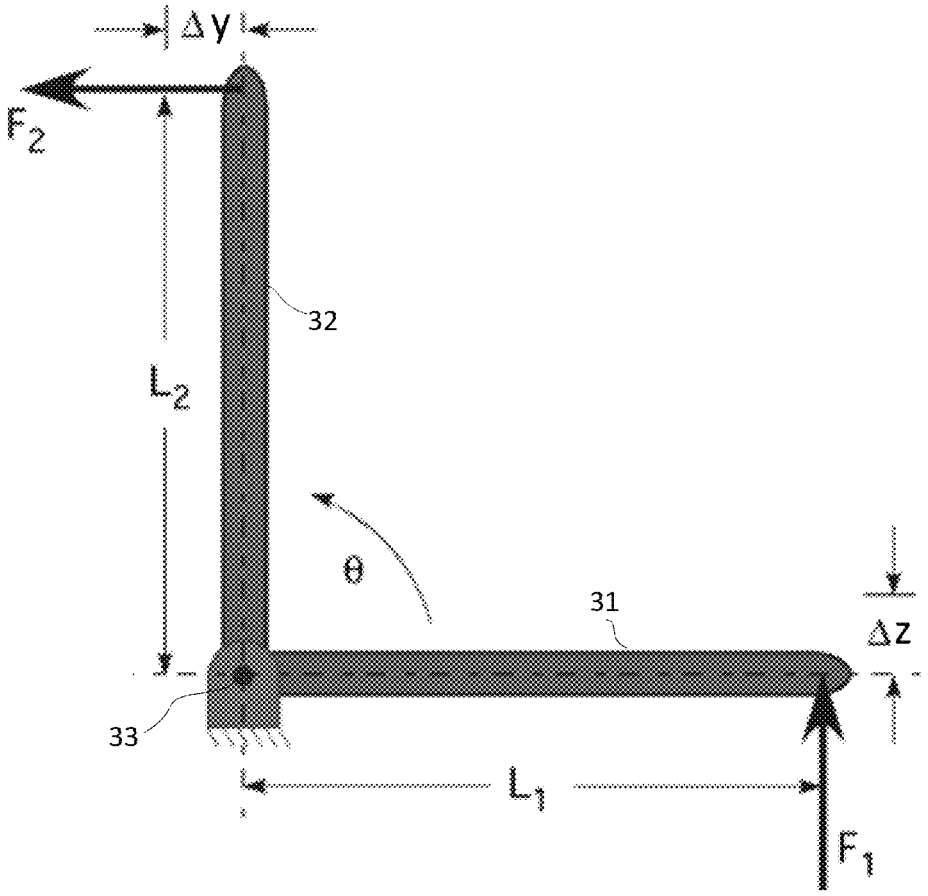
FIG. 3 illustrates a bell-crank mechanism for converting a vertical movement into a horizontal movement.

The conversion of a vertical movement into a horizontal printhead translation can be made using a wedge or a bell-crank mechanism, as illustrated in FIG. 3. The bell-crank mechanism has a first crank arm 31 of a first length $L_1$ in the y-direction and a second crank arm 32 of a second length $L_2$ in the z-direction, connected together at a pivot point 33. A force $F_1$ in the z-direction applied to the first crank arm 31, causes a small movement $\Delta z$ of the first crank arm 31 in the z-direction. This is translated into a small movement $\Delta y$ of the second crank arm 32 in the y-direction. By adjusting the relative lengths $L_1$, $L_2$ of the crank arms it is possible to create a very fine translational movement in the y-direction from a less fine vertical adjustment in the z-direction. This translational adjustment may be automated, e.g. by using a motor.

The conversion of a vertical movement into a rotation about the vertical axis in order to effect a rotational adjustment is harder to achieve, particularly if the space available is limited, as is often the case in print carriages, particularly in the along-process direction. There is described herein an arrangement of flexural hinges fabricated in the printhead support 215. The flexural hinges may be combined with a diagonal link between a pair of flexures; the angle of the diagonal linkage can be used to convert a coarse vertical movement into a finer horizontal movement. The horizontal movement is then used to create a rotation about a vertical pivot axis.

Figure 4:
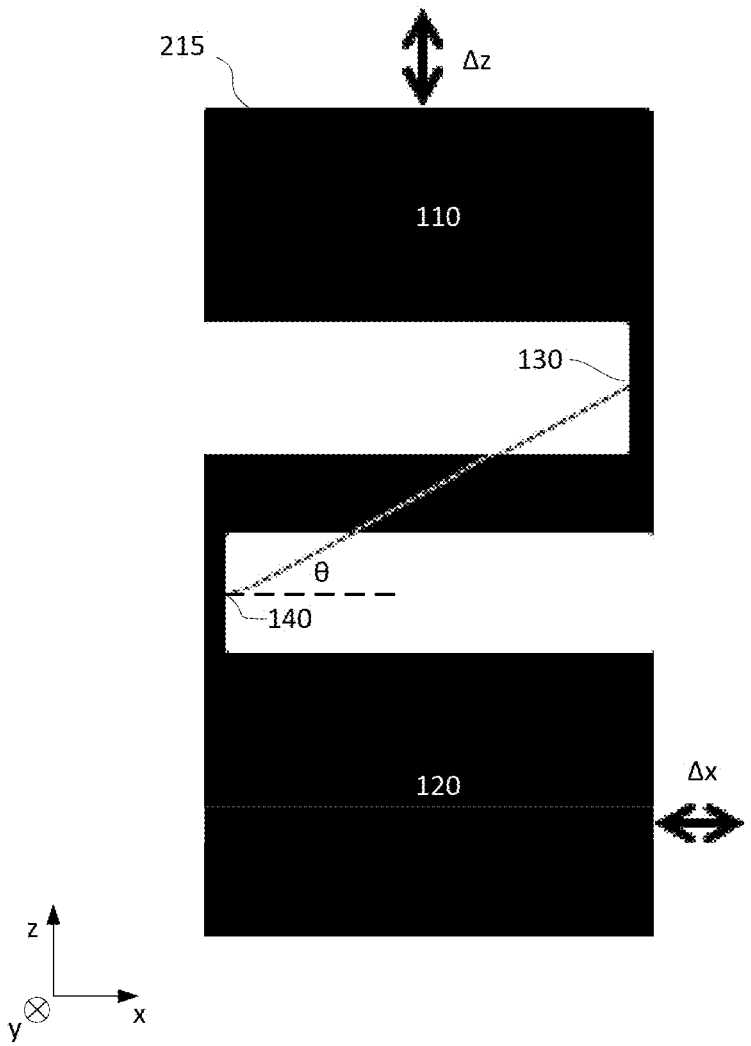
FIG. 4 illustrates a printhead adjustment mechanism according to an exemplary embodiment.

Referring to FIG. 4, an exemplary embodiment will now be described. FIG. 4 shows part of a printhead adjustment mechanism which may be used within the printhead supports 215(*a-e*) shown in FIG. 9. The printhead adjustment mechanism is formed of a section of the printhead support 215(*a-e*) structures shown in FIG. 9. The printhead adjustment mechanism is used for converting a movement or force in the z-direction into a force in the x-direction. This can be used to convert translational movement in the z-direction to rotational movement in the x-y plane A set of conventional right-hand orthogonal axes are assumed in this example. When installed in a printer assembly, an array of printheads would lie in the x-y plane, and the z-axis would be perpendicular to the array of printheads.

The section of the printhead adjustment mechanism shown in FIG. 4 has a first portion 110, which is constrained to move predominantly in the z-direction, and a second portion 120, which is constrained to move predominantly in the x-y plane. Between these portions is a pivot portion having a first flexure 130 and a second flexure 140, which are diagonally opposed in the x-z direction. A diagonal linkage between the first flexure 130 and the second flexure 140 is at an angle θ to the x-direction. The flexures 130, 140 are formed by machining pockets in the printhead support 215 material, leaving thin sections of metal which act as a flexural pivot mechanism. The first portion 110 is the "input" side of the mechanism and its movement may be actuated by, for example, a screw with an axis along the z-direction being turned. The second portion 120 is the "output" side of the linkage and its movement can be used to effect a rotation about an axis parallel to the z-axis as described in more detail below, and hence effect the desired rotational adjustment of the printhead 220. The printhead 220 is in communication with the second portion 120; in one example, the printhead 220 is clamped or fixed directly to the second portion 120, in another example the printhead 220 is fixed to another portion of the printhead support structure, but be in contact with the second portion 120, such that movement of the second portion 120 will cause the printhead 220 to move. The pivot portion is configured such that a force in the z-direction Δz on the first portion 110, which causes the first portion 110 to move translationally in the z-direction, produces a force on the second portion in the x-direction Δx. The second portion 120 is fixed (not shown) along an edge in the z-direction, so the x-directional force Δx causes the second portion 120 to rotate about the fixing in the x-y plane. The fixing of the second portion 120 may, for example, be provided in the form of another flexure strip or hinge, as described in more detail below.

Figure 5A:
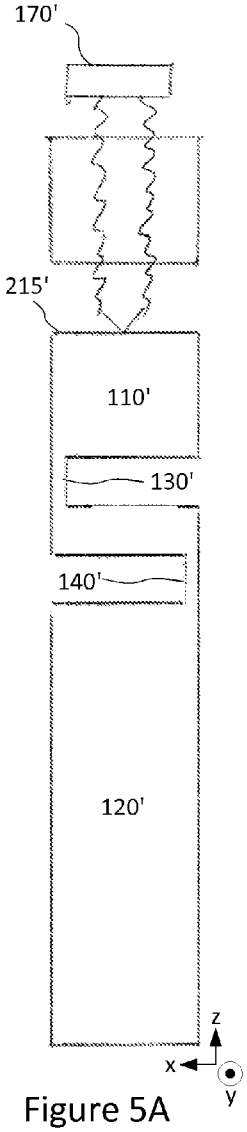
FIG. 5A illustrates the printhead adjustment mechanism of FIG. 4 in context within a printhead support structure from a first direction.
Figure 5B:
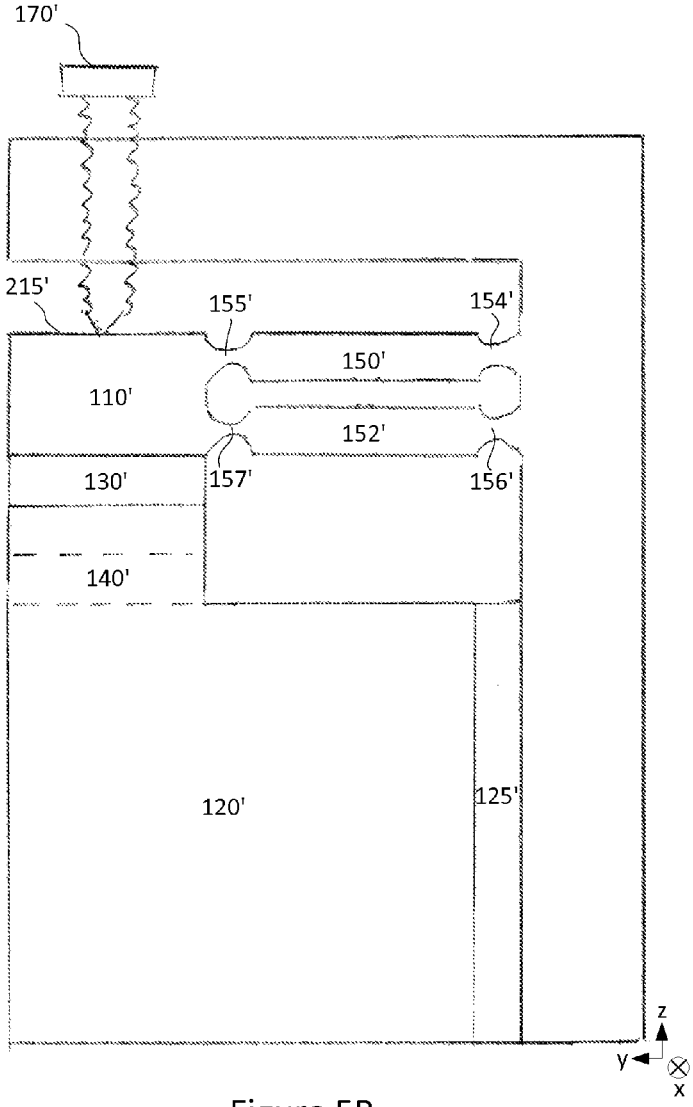
FIG. 5B illustrates the printhead adjustment mechanism of FIG. 5A from a second direction.
Figure 5C:
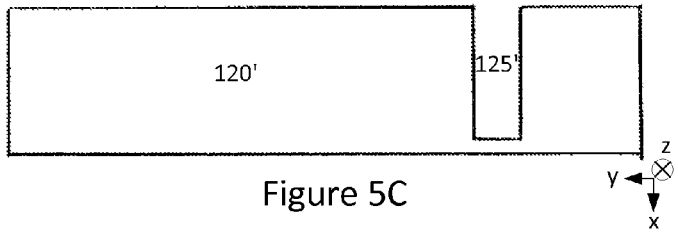
FIG. 5C illustrates the printhead adjustment mechanism of FIG. 5A from a third direction.
Figure 5D:
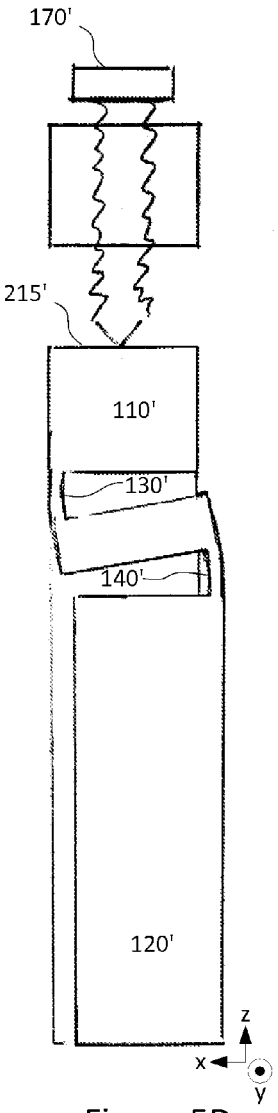
FIG. 5D illustrates the printhead adjustment mechanism of FIG. 5A from the first direction after actuation of an adjustment.
Figure 5E:
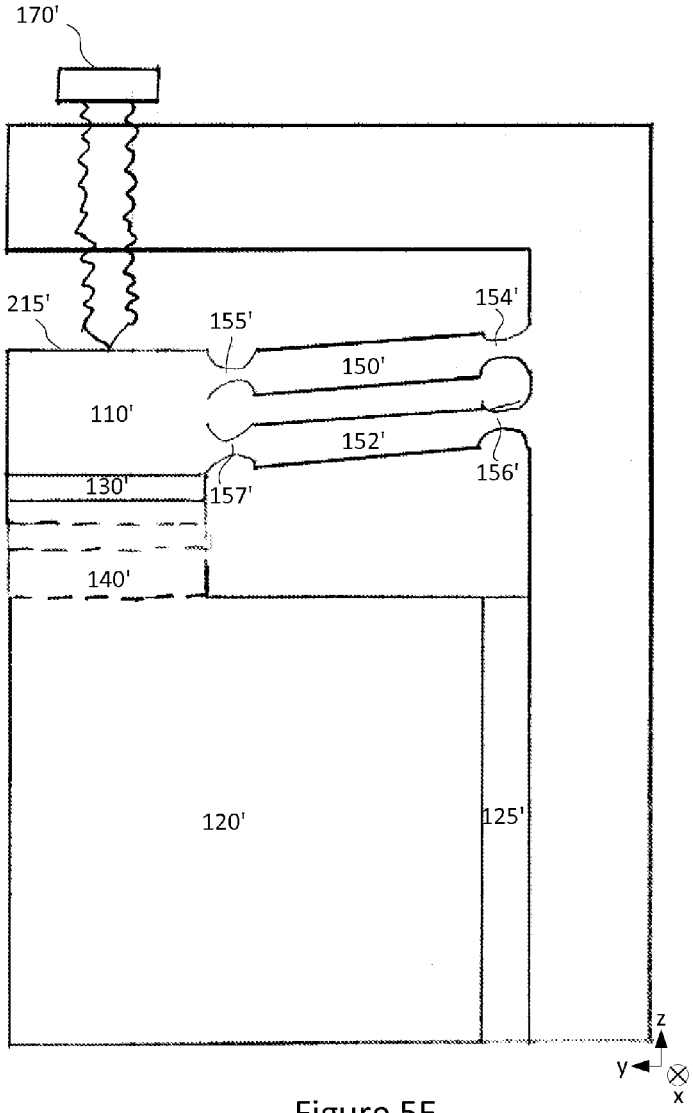
FIG. 5E illustrates the printhead adjustment mechanism of FIG. 5B from the second direction after actuation of an adjustment.
Figure 5F:
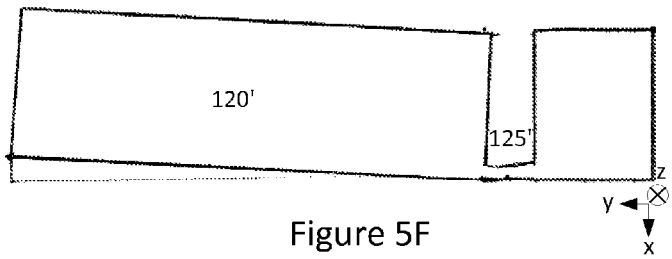
FIG. 5F illustrates the printhead adjustment mechanism of FIG. 5C from the third direction after actuation of an adjustment.

The rotational movement of the printhead 220 provided by this arrangement will thus effect a rotation about the point at which the second portion 120 is fixed. FIGS. 5A, 5B and 5C show the printhead adjustment mechanism of FIG. 4 in context within a printhead support 215' structure in a first position. Each of these figures shows the printhead adjustment mechanism from a different direction; a set of conventional right-hand orthogonal axes are shown on each. FIGS. 5D, 5E and 5F show the printhead support structure 215' from the different directions shown in FIGS. 5A, 5B and 5C respectively, in a second position, after an adjustment to the rotational alignment of the printhead 220 has been actuated. Like reference numerals have been used to described like components across FIGS. 5A-F.

FIG. 5A is a view from the y-direction, and shows an adjuster screw 170' in communication with the printhead adjustment mechanism. The printhead adjustment mechanism has a first portion 110', which is constrained to move predominantly in the z-direction, and a second portion 120', which is constrained to move predominantly in the x-y plane. Between these portions is a pivot portion having a first flexure 130' and a second flexure 140'.

FIG. 5B shows the printhead adjustment mechanism from the x-direction. Adjacent to the first portion 110' in the z-direction are two segments 150',152' which constrain the first portion 110' to move predominantly in the z-direction. Due to the construction of the segments 150', 152', a force on the first portion in the z-direction will in reality cause the first portion also to move slightly in the y-direction as it moves in the z-direction, such that it moves in an arc. In this example, each constraining segment 150', 152' has a flexure 154'-157', at each end to allow movement substantially along the z-direction. FIG. 5E shows how the flexures and constraining segments allow the first portion 110' to move predominantly in the z-direction. Compared to FIG. 5B, the adjuster screw 170' in FIG. 5E has been advanced in the negative z-direction. The flexures 154', 155', 156', 157' have been bent to allow the left-hand side of the constraining segments 150', 152', and hence the first portion 110', to advance predominantly in the negative z-direction, but not significantly in the x- or y-directions.

FIG. 5D shows how, when the first portion 110' is caused to advance in the negative z-direction, the first and second flexures 130', 140' bend to force the end of the second portion 120' to move in the negative x-direction.

FIG. 5B also shows a fixing strip 125', which secures the second portion 120' to the printhead support 215' structure along an edge in the z-direction. This fixing strip 125' may, for example, also be formed of a flexure or flexural hinge, cut into the body of the printhead support 215'. The fixing strip 125' ensures that one end of the second portion 120' cannot move in the x-direction so application of the force in the x-direction by the first portion 110' causes the second portion 120' to move rotationally in the x-y plane.

Since the second portion 120' is constrained by the fixing strip 125' to move rotationally in an x-y plane, when the left-hand side of the second portion 120' is advanced in the negative x-direction, the entire second portion 120' moves rotationally around the fixing strip 125' in the x-y plane. This can be seen from FIGS. 5C and 5F, which show how the fixing strip 125' bends to allow the second portion 120' to move rotationally in an x-y plane. The second portion 120' is in communication with the printhead 220, such that rotation of the second portion 120' in an x-y plane causes rotation of the printhead 220 in an x-y plane and hence allows the rotational alignment of the printhead 220 to be adjusted.

The mechanism is compact, as it only requires removal of material from the existing printhead support structure. Having such a compact adjustment mechanism means it is possible to pack the printheads in a very tight array, which improves the quality of printing, and the speed of printing in multi-pass printers.

The arrangement of flexures with a diagonal linkage, as shown in FIG. 4, provides a reduction ratio to match the resolution of the mechanical actuation with the required printhead rotation. The diagonal linkage converts motion in the z-direction to motion in the x-direction in the ratio of the sides of the right-angled triangle having the diagonal linkage as hypotenuse; i.e. $\Delta x=\Delta z*\tan(\theta)$. This allows the input of a fairly large actuation movement in the z-direction, to be converted into a smaller movement in the x-direction, so that the magnitude of the rotational movement of the outer edge (i.e. the edge opposed to the fixing strip 125') of the second portion 120' is smaller than the magnitude of the actuation movement, and hence allow adjustment of the printhead to a higher degree of accuracy. The ratio between the size of the movement of the second portion 120 in the x-direction (Δx) and of the movement of the first portion 110 in the z-direction ($\Delta z$) will be less than 1 for any $\theta<45°$, and becomes smaller as $\theta$ is reduced to 0°.

The flexures may be formed in the body of the printhead support or clamp. Wire erosion may be used to cut the flexures. In reference to the embodiment of FIG. 4, flexures in the x-axis direction can give movement in the y-z plane. Machined pockets are used to form flexures and linkages giving translational movement in the x-z plane and rotation parallel to the z-axis.

In some embodiments, the adjuster screw 170' shown in FIGS. 5A-F may be a manually adjusted screw, used to apply the input z-axis actuation, and in alternative embodiments, motors (e.g. stepper motors) may be used to drive the adjuster screw 170'. This has several advantages. A motor makes it possible to adjust the positioning of the printhead automatically, under computer control, and with no manual intervention, and potentially from a distance, for example over a network connection. Computers eliminate "human error" and can also perform tasks quicker than a human operator and/or control multiple tasks at once. This can be particularly advantageous in print arrays with many (e.g. 100+) printheads. By using stepper motors in combination with fine pitched leadscrews, the system remains in position when power is removed. This eliminates the need for a locking device. Commonly, adjustment systems require a cycle of unlock, adjust, lock. The locking phase normally produces some unwanted movement, making precise adjustment difficult. A locking step also makes systems harder to automate. The presently described mechanism avoids a locking step because flexures do not have any backlash or slop, unlike e.g. a sliding hinge, and therefore do not require a locking or securing component.

The mechanical leverage provided by the diagonal linkage means that large forces on the printhead only produce small forces at the adjustment mechanism, and in particular the actuation means, i.e. the adjustment screw. This is another reason the printhead can remain correctly aligned without the need for locking.

The mechanism can be designed in such a way that any sliding part involved in positioning the printhead is decoupled from the printhead through the levered flexure components with a ratio of less than 1 (e.g. by choosing a value of $\theta$ of less than 45°). This means that any movement between the sliding elements (e.g. screws) caused by for example vibration, changing loads or thermal cycling is divided down with regard to resulting changes in printhead position. Therefore, the adjustment is fairly stable and readjustments are not often required. In some cases, it has been found that readjustment is not needed at all during the life of the printhead.

It is possible to use the flexure arrangement described above to couple the translation and rotation actuations in order to effect a composite "pure" rotation about an axis parallel to the z-axis but passing through any desired point in the x-y plane (normally the centre of the x-y array of nozzles is chosen). This has the advantage that the two alignments can be made with the same adjustment so that alignment can be accomplished more quickly.

The rotational movement of the printhead 220 provided by the arrangement described above in relation to FIGS. 4 and 5A-F will normally effect a rotation about the fixing strip 125' along which the second portion 120' is fixed. However, in certain situations the rotational adjustment is not required about this fixing strip 125'. For example, it is often preferable to provide a rotational adjustment about the centre of the nozzle array, but it is hard to provide a fixing strip 125' which corresponds with the centre of the nozzle array. Therefore, to align a printhead correctly it can be necessary to also apply a translational adjustment. This can be provided by means of a bell crank, as described above in relation to FIG. 3.

The translational movement may also be actuated from the z-direction by means of another adjuster screw, and this second adjuster screw may also be controlled by a motor.

The presently described adjustment mechanism allows the actuation of the rotational printhead adjustment to be accessible vertically. I.e. printhead rotation about the z-axis can be actuated by a vertical movement in the z-direction. This allows adjustment of individual printheads, even when they are tightly packed in an array (i.e. a printhead array in an x-y plane).

Matrices can be used to describe rotation and translation steps, and a specific example of how matrices can be used will now be described in a system which uses stepper motors to actuate the adjustment mechanism.

When both rotational and translational adjustments are each actuated by a stepper motor, the desired rotation and translation, $x_i$, can be achieved by applying steps, $n_j$, to the two stepper motors. There is some degree of mechanical coupling between these motions, so the general relationship is of matrix form: $x_i=A_{ij}\,n_j$, where A is a square matrix. The elements of the matrix A are determined by the geometry of the mechanical system. In most systems, the matrix will be non-singular and so possess an inverse. Given a desired adjustment in position and rotation, $x_i$, the number of stepper motor steps to be applied to the adjustment axes is simply: $n_j=A^{-1}_{ji}\,x_i$.

The parasitic motions in the along-process direction (and possibly other directions) may be written as: $y_i=B_{ij}\,n_j$, where B is a matrix, not necessarily square. We could also write $y_i=C_{ij}\,x_j$ where $C_{ij}=B_{ik}\,A^{-1}_{kj}$. Hence, given a desired degree of adjustment, the number of stepper motor steps can be calculated directly and the size of the parasitic along-process motions resulting from these steps can also be calculated. Once the difference in along-process translational alignment (or parasitic offset) between neighbouring printheads is determined, it is possible to calculate how firing of the nozzles on different printheads should be delayed to ensure correct distribution of ink on the substrate.

Image Analysis for Printhead Alignment

The adjustments required to correctly align printheads can be calculated in several ways. One way is to print a test pattern and determine the alignment by capturing and analysing an image of the test pattern. Alternatively, a camera could be mounted on the printing apparatus (e.g. on the print carriage) to measure nozzle positions.

A printed image can be analysed to locate the relative positions of the centroid of printed features (i.e. the printhead nozzles), from which the degree of adjustment needed can be calculated.

The printed image analysis can include finding the Fourier transform of a printed pattern of lines of ink laid down by printhead nozzles. When correctly aligned, the Fourier transform should show a perfectly periodic structure. I.e. the Fourier transform would show the primary frequency and peaks corresponding to higher harmonics, but not to sub-harmonics. Poor alignment leads to sub-harmonics of the correctly aligned pattern periodicity. Interactive adjustments can be made to minimise the magnitude of the sub-harmonics.

Inspection of the local density of a print can use an imaging resolution well below that of the printing grid. By careful choice of printed pattern it is possible to discriminate between along-process and cross-process direction misalignments. This is particularly useful as printhead adjustment is normally performed to achieve prints with no artefacts visible to the eye.

Image analysis for printhead alignment will now be described in relation to one example embodiment. A 1200 dpi (47.2 dpmm) single pass printhead can provide full ink coverage across a substrate in the cross-process direction if all nozzles are fired simultaneously. Therefore, in order to provide a pattern which can provide information regarding rotational and translational alignment, a special test pattern is required.

Test Patterns for Visual Inspection and Manual Adjustment

In general, the lines that make up a test pattern should simply be printed from every nth nozzle, where n is not a factor of the number of rows of nozzles (i.e. the number of nozzle rows is not exactly divisible by n) on a printhead. In one example, when there are 32 rows of nozzles on each printhead, a row of lines may be printed from every 7th nozzle. In this case, odd and even nozzles are on different sides of the printhead, rotational inaccuracies will show up as "twinning" of the lines. This is shown in the test print of FIG. 7A, in which lines of ink 20 laid down by printhead nozzles appear in closely-spaced pairs. This shows the printhead is not correctly rotationally aligned. When correctly aligned rotationally, the "twinning" is no longer apparent and the lines are equally spaced, as shown in FIG. 7B.

A real-time Fourier transform can be used to assist manual adjustment. When incorrectly aligned, the "twinning" gives a repeat period at half the spatial frequency of the correctly aligned image. Therefore minimising the sub-harmonic frequency leads to better rotational alignment.

Figure 7A:
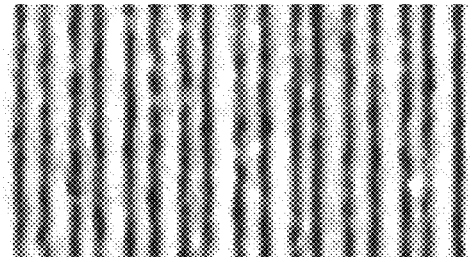
FIG. 7A illustrates a test print for a printhead which is incorrectly rotationally aligned.
Figure 7B:
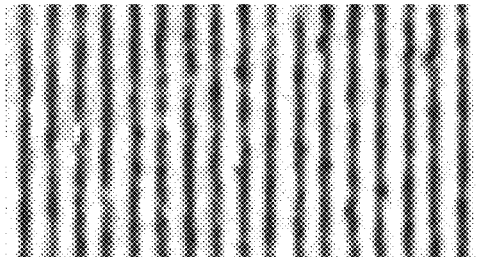
FIG. 7B illustrates a test print for a printhead which is correctly rotationally aligned.
Figure 8A:
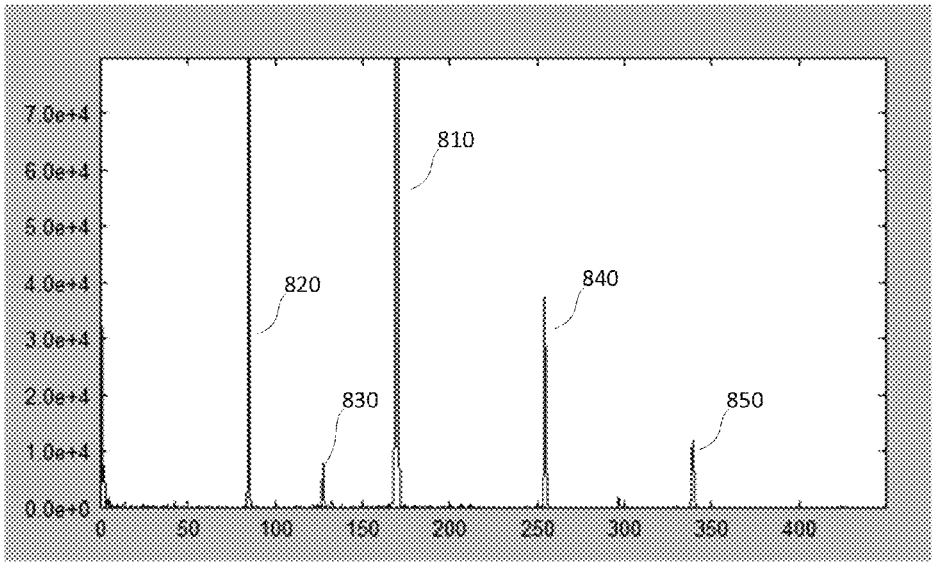
FIG. 8A illustrates a Fourier transform created from the test print of FIG. 7A.
Figure 8B:
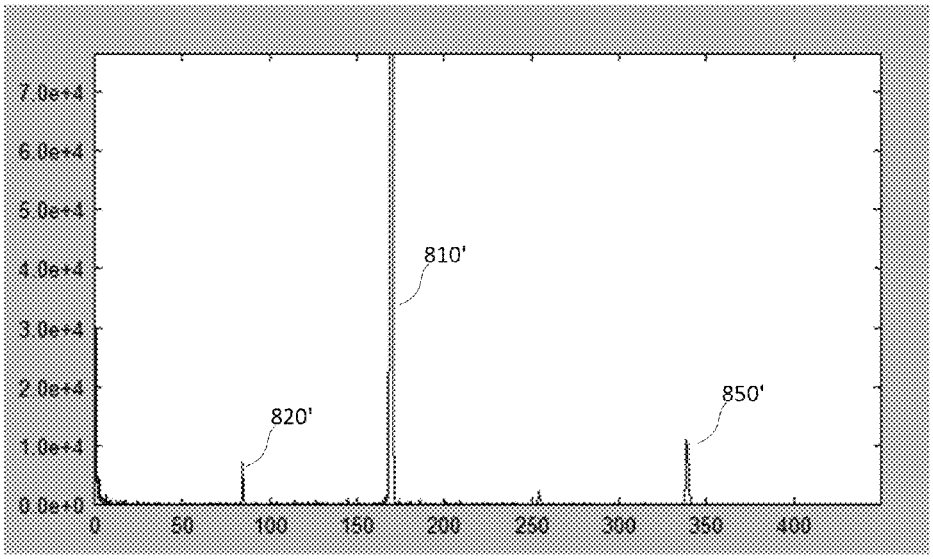
FIG. 8B illustrates a Fourier transform created from the test print of FIG. 7B.

FIGS. 8A and 8B show Fourier transforms created from the test print images of FIGS. 7A and 7B, respectively. FIG. 8A, which corresponds to the misaligned printheads, shows strong frequency peaks (810 and 820) at ~170 $in^{-1}$ (6.69 $mm^{-1}$) and ~80 $in^{-1}$ (3.15 $mm^{-1}$) and weaker peaks (830, 840 and 850) at ~140 $in^{-1}$ (5.51 $mm^{-1}$), ~250 $in^{-1}$ (9.84 $mm^{-1}$) and ~340 $in^{-1}$ (13.39 $mm^{-1}$). In FIG. 8B, which corresponds to the printheads being better aligned, there is a strong peak (810') at ~170 $in^{-1}$ and weaker peaks (820' and 850') at ~80 $in^{-1}$ (3.15 $mm^{-1}$) and ~340 $in^{-1}$ (13.39 $mm^{-1}$).

Referring to FIG. 8A, the first harmonic peak (810) is at spatial frequency ~170 $in^{-1}$ (6.69 $mm^{-1}$) and the peak (850) at ~340 $in^{-1}$ (13.39 $mm^{-1}$) is twice the harmonic spatial frequency (i.e. the second harmonic). Whereas the peak (820) at ~80 $in^{-1}$ (3.15 $mm^{-1}$) corresponds to half the harmonic spatial frequency and the peak (840) at ~250 $in^{-1}$ (9.84 $mm^{-1}$) corresponds to 1.5 times the harmonic spatial frequency. It can be seen that when printheads are correctly aligned (see FIG. 8B), the sub-harmonic frequencies 820, 830, 840, 850 that occur between the first and second harmonic peaks 810, 850 are significantly reduced.

The image analysis process can set certain tolerances or thresholds for sub-harmonic frequencies and determine that the printhead is correctly aligned when these sub-harmonics are below certain threshold values.

Figure 7C:
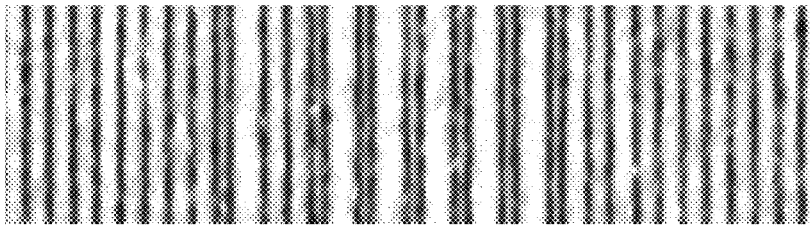
FIG. 7C illustrates a test print for printheads which are misaligned in the cross-process direction.
Figure 7D:
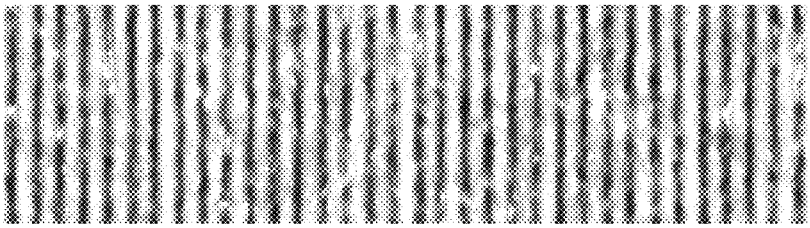
FIG. 7D illustrates a test print for printheads which are correctly aligned in the cross-process direction.

Translational adjustment can also be based on this approach by imaging the overlap region between two printheads which are rotationally aligned but are not correctly aligned in the cross-process direction. FIG. 7C shows the overlap region of a test pattern for printheads which are misaligned in the cross-process direction. FIG. 7D shows the same overlap region when the printheads are correctly aligned in the cross-process direction.

Figure 8C:
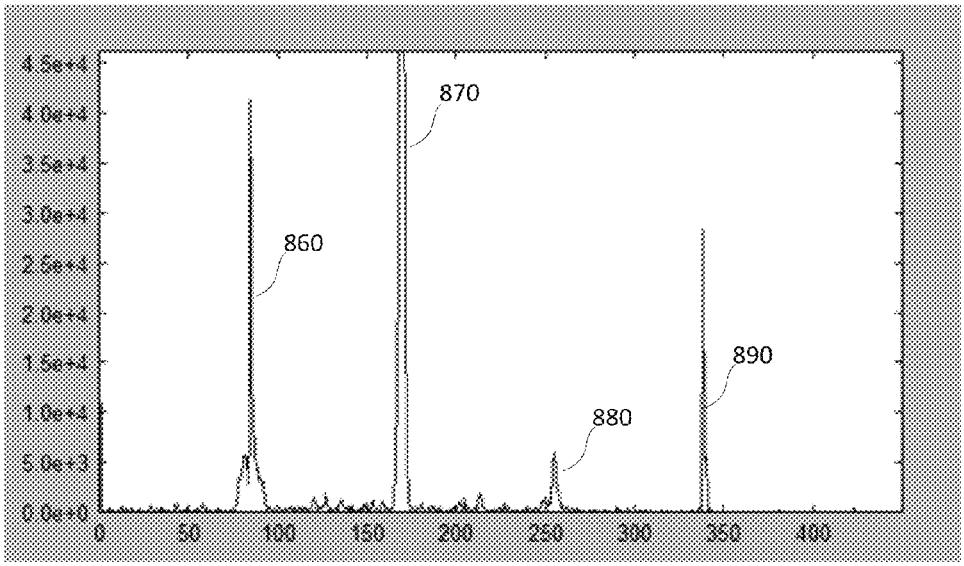
FIG. 8C illustrates a Fourier transform created from the test print of FIG. 7C.
Figure 8D:
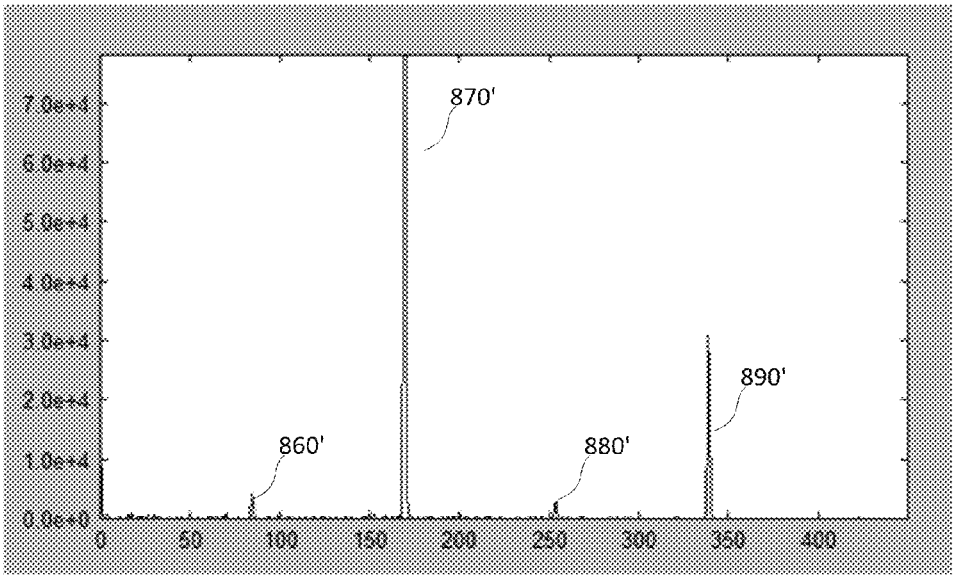
FIG. 8D illustrates a Fourier transform created from the test print of FIG. 7D.

The mismatch in the overlap region also gives rise to a sub-harmonic peak, which is minimised when the alignment is correct. FIGS. 8C and 8D show Fourier transforms created from the test print images of FIGS. 7C and 7D, respectively. In FIG. 8C, the first and second harmonic peaks (870, 890) at ~170 $in^{-1}$ and ~340 $in^{-1}$ can be seen. A strong sub-harmonic peak 860 at ~80 $in^{-1}$ and a weaker sub-harmonic peak 880 at ~250 $in^{-1}$ can also be seen. In FIG. 8D, which corresponds to the printheads being better aligned, the first and second harmonic peaks (870', 890') at ~170 $in^{-1}$ and ~340 $in^{-1}$ are still relatively strong, whereas the sub-harmonic peaks (860', 880') at ~80 $in^{-1}$ and ~250 $in^{-1}$ are much weaker.

When test patterns are analysed for automated adjustment, the requirements differ from those for manual adjustment. For example, the processing time may be longer than for a system providing real-time feedback to a human operator. Additionally, the output used to re-position the heads must not need any human "interpretation", i.e. the output instructions must be suitable to be input straight into the automatic adjustment means, e.g. motors.

Figure 10:
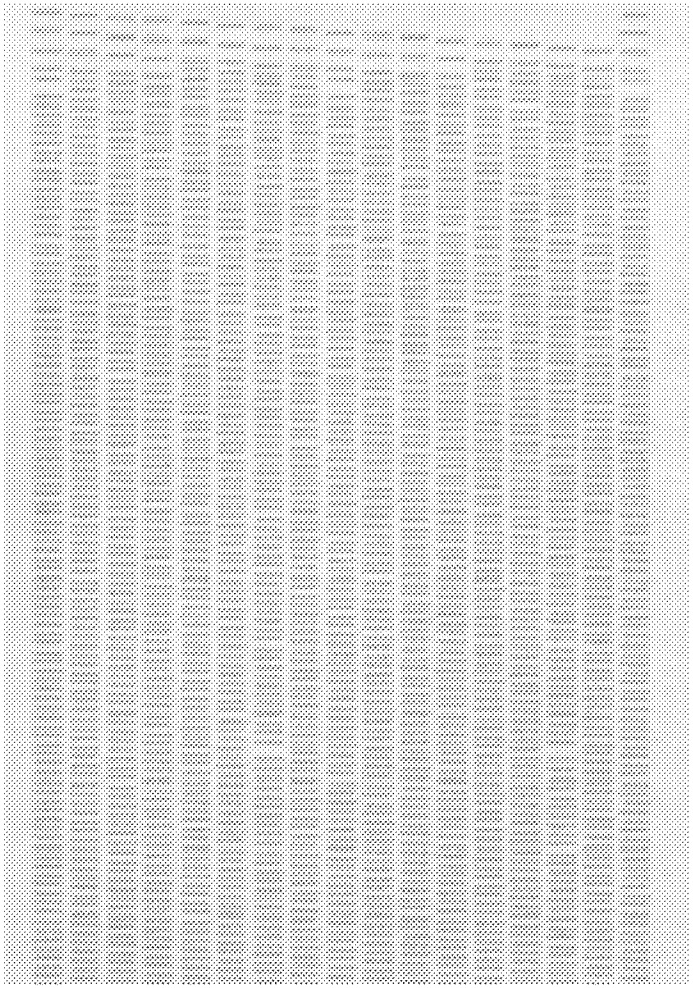
FIG. 10 illustrates a section of a typical test pattern.

A section of another typical test pattern is shown in FIG. 10. Each row in the pattern has a short "tick mark" drawn for every 16th nozzle. There are 17 rows of tick marks, with the first and last rows coming from the same set of nozzles.

An image processing program can analyse the image to identify the location of every tick mark and from this deduce the relative position and rotation of each printhead. This information can be used as input to the inverted matrix equation to drive each printhead directly to the correct degree of rotation and translation. A second image can be printed and processed to confirm the adjustment has been carried out to the required degree of accuracy and to perform further refinement, if needed.

Test Patterns for Adjusting Alignment Based on Colour Density

Test patterns can also be used to determine how well printheads of different colours are aligned to each other. An example test pattern for comparing alignment of black and magenta printheads may comprise a series of lines drawn by the black printheads on a print carriage. In this example, black lines would be printed from the top to the bottom of the image in the along-process direction. On top of these black lines would be drawn separate blocks of magenta lines, spaced apart in the along process direction, but each magenta block covering substantially the same width in the cross-process direction as the black lines. Each magenta block would be displaced slightly in the cross-process direction with respect to the block preceding it.

When the lines from the magenta block fall directly on top of those of the underlying black pattern, there is a significant change in optical density, which can be judged either by eye, or by using a low resolution digital camera.

In the example just given, alignment between different colours can be set. When aligning within a colour, a similar technique can be used, but with the pitch of the lines so selected that a maximum of optical density is achieved at the point of correct alignment.

In another example, sets of black and yellow lines may be overprinted. Where the alignment is good, only black is visible, but where the alignment starts to drift out yellow colour tinges will be seen as the yellow is not fully occluded by the black.

Typical Alignment Procedure

Figure 6:
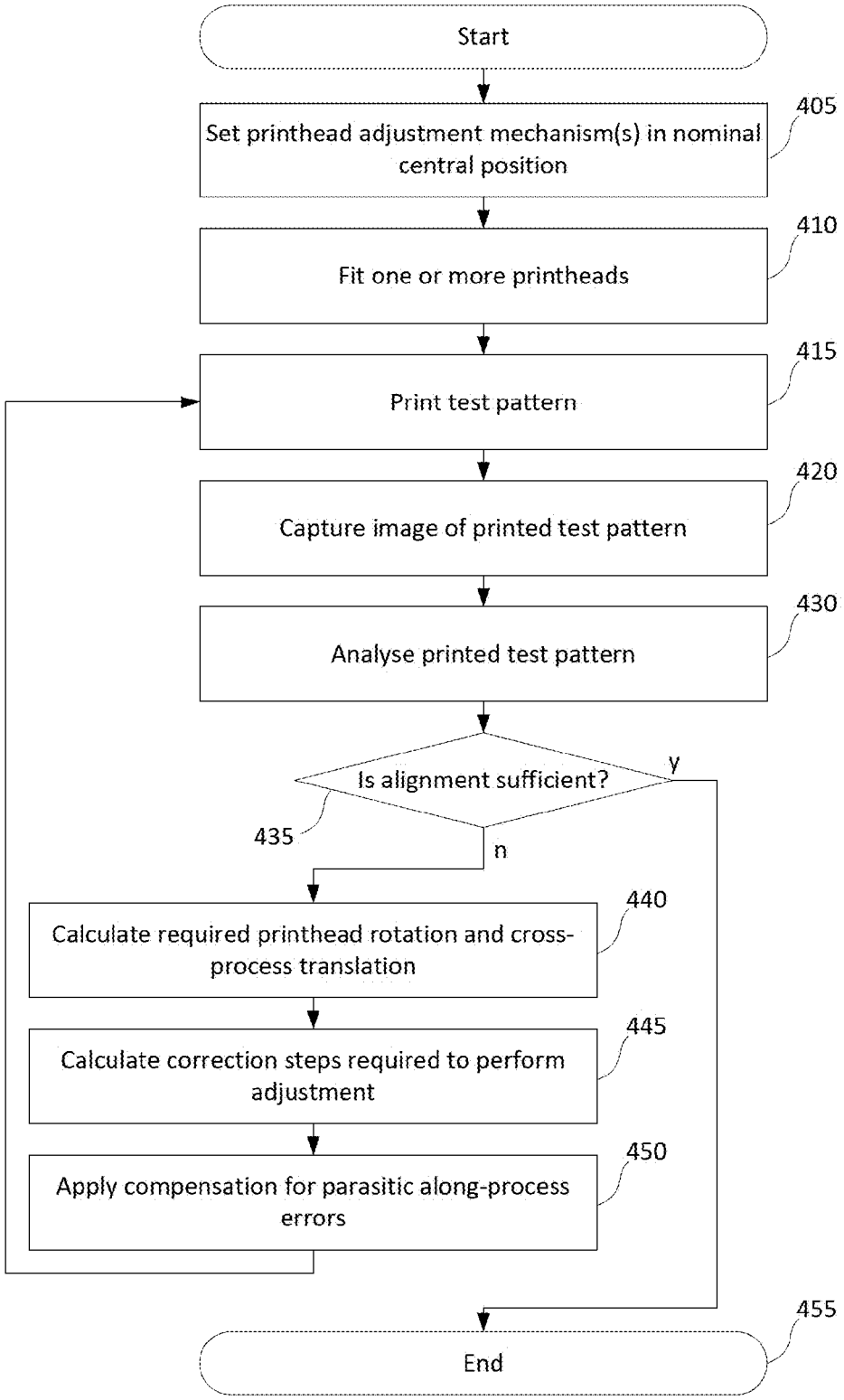
FIG. 6 illustrates a method for aligning or adjusting printheads.

A method for aligning or adjusting printheads within a printhead array on a print carriage using the above-described printhead adjustment mechanism will now be described in relation to FIG. 6.

At step 405, the printhead adjustment mechanisms on a print carriage are set to their nominal central positions.

At step 410, one or more printheads are fitted onto printhead support portions on the print carriage in a printhead array. The printheads may all be individually replaceable.

At step 415, a test pattern from all printheads is printed. The test pattern will contain features printed by a set of nozzles from each printhead.

At step 420, an image of the printed test pattern is captured using a camera system (e.g. linescan camera or conventional camera) and appropriate illumination.

Figure 1:
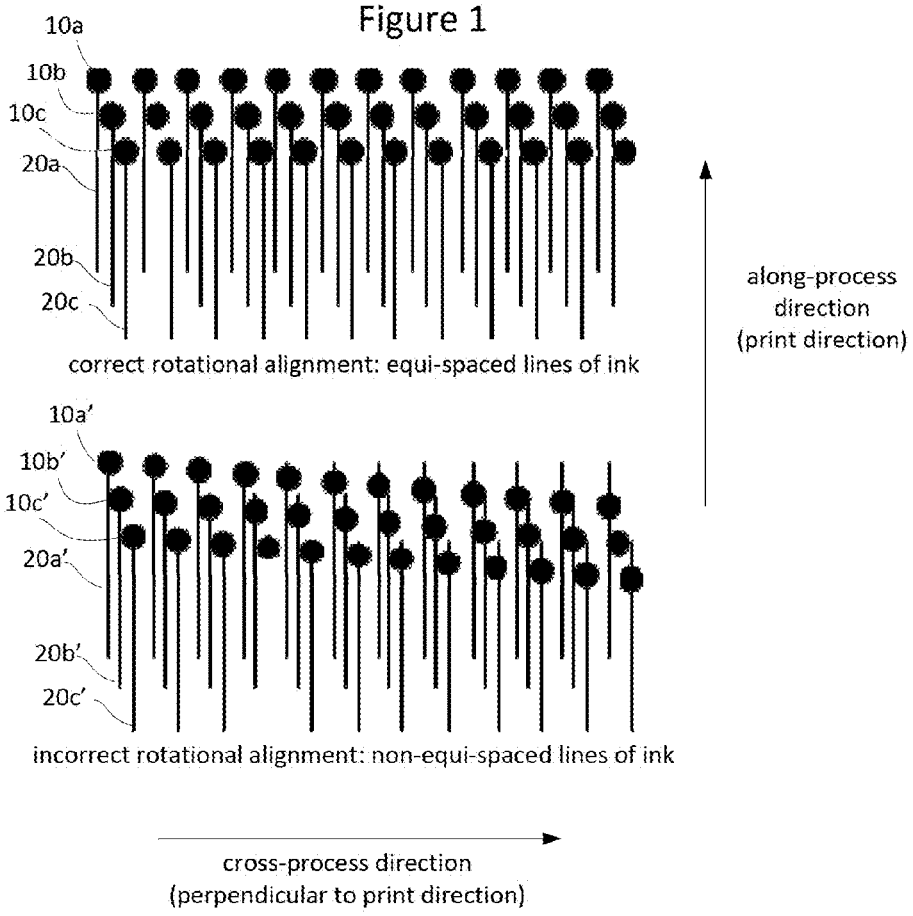
FIG. 1 illustrates the spacing of lines laid down by printhead nozzles when a printhead is correctly and incorrectly rotationally aligned.
Figure 2:
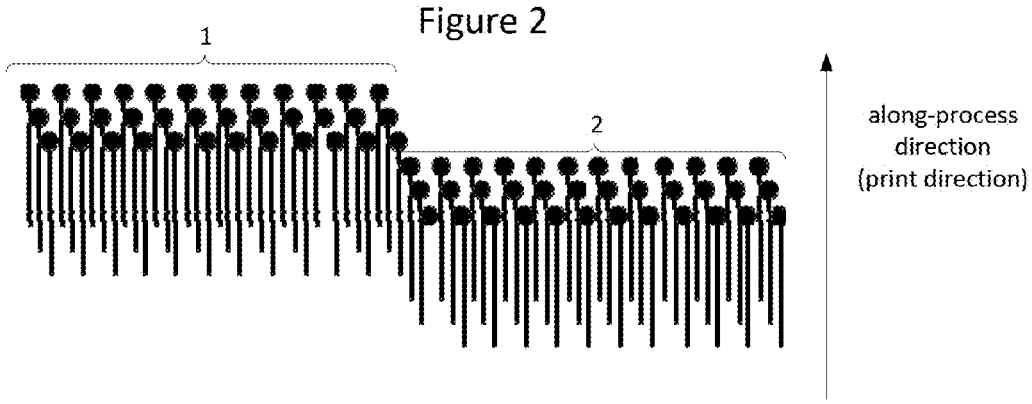
FIG. 2 illustrates the lines laid down by printhead nozzles in printheads that are not aligned in the along-process (print) direction.

At step 430, image analysis software is used to measure the relative positions of the features printed by the nozzles. For example, if a printhead is incorrectly rotationally aligned with respect to the movement of the print carriage in the along-process direction, the lines of ink laid down by adjacent nozzles will not be equally spaced (as is described above in relation to FIG. 1). Additionally, if adjacent printheads are not correctly translationally aligned in the cross-process direction, lines of ink laid down by the nozzles on adjacent printheads will not be equally spaced. Errors in along-process alignment can also be detected in this step.

At step 435, a determination, or decision, is made as to whether the printhead is sufficiently aligned. Printers may require different degrees of alignment in different situations, so it may be possible to set different alignment tolerances.

If the alignment is sufficient, the printhead alignment method will end (step 455).

If the alignment is insufficient, the alignment method proceeds to step 440, in which the rotational and translational adjustments required for each printhead are calculated from the measured positions. By providing details of the design and dimensions of printhead components (i.e. the nozzle array) to image analysis software, it is possible to calculate the adjustments needed to align within and between each printhead.

At step 450, the correction steps required to apply the adjustments identified in step 430 to each printhead are calculated. This could comprise, for example, the size of the actuation movement in the z-direction, which should be applied to the first portion 110 of the adjustment mechanism. When a motor is used to provide the actuation movement, this step could output the specific movement required for the motor. Calculating the correction steps can be done using the matrix equations described above.

At step 450, the timing of the printhead firing is adjusted to provide suitable compensation for the along-process (or parasitic) parasitic errors in printhead alignment.

The method then returns to step 415 in order to measure and analyse the printhead alignment and adjust the alignment if the accuracy is insufficient.

This method will continue until the desired accuracy of alignment is attained and this is determined in step 435. If the printhead adjusters have a low degree of backlash and hysteresis, then it should be possible to achieve adequately accurate alignment with a single stage of measurement and adjustment. For example, the combination of a stepper motor to turn a screw has little backlash or hysteresis.

A method for determining the adjustment required for printhead alignment, may comprise some or all of the steps of:

printing a test pattern from one or more printheads;

capturing an image of the printed test pattern;

analysing the image of the printed test pattern to determine the alignment of said one or more printheads;

calculating the required printhead rotational adjustment; and calculating the correction steps required to perform said rotational printhead adjustment.

Preferably, the analysing the image comprises performing a frequency analysis, for example Fourier analysis. The frequency analysis could also comprise identifying a first harmonic frequency and identifying one or more sub-harmonic frequencies. The first harmonic frequency can be identified by calculating the expected harmonic frequency based printhead nozzle separation or resolution.

Preferably, the required printhead rotational adjustment comprises the adjustment which is required to minimise the one or more subharmonic frequencies.

The printed test pattern can comprise a plurality of parallel features, which would normally extend in the along-process direction. When this is the case, the frequency analysis would comprise analysing the frequency of the parallel features.

Whenever a subset of one or more printheads in the array is replaced, the same method can be applied. Ideally, it should only be necessary to adjust those printheads which have been replaced. However, with the use of an automated motorised system, there is little penalty in carrying out a complete re-alignment of the system.

Any system feature as described herein may also be provided as a method feature, and vice versa. As used herein, means plus function features may be expressed alternatively in terms of their corresponding structure.

Any feature in one aspect of the invention may be applied to other aspects of the invention, in any appropriate combination. In particular, method aspects may be applied to system aspects, and vice versa. Furthermore, any, some and/or all features in one aspect can be applied to any, some and/or all features in any other aspect, in any appropriate combination.

It should also be appreciated that particular combinations of the various features described and defined in any aspects of the invention can be implemented and/or supplied and/or used independently.

The invention claimed is:

1. A printhead support structure, comprising:

a receiving portion for receiving a printhead;

first and second portions having a flexure therebetween configured to convert a translational movement of the first portion to a rotational movement of the second portion; and a coupling mechanism for coupling the second portion to said receiving portion for adjusting the rotational angle of the printhead; wherein:

the first portion is coupled to a print carriage and constrained to move substantially along a first axis; and the second portion is fixed at an edge, such that the second portion is constrained to rotate about a second axis parallel to the first axis.

2. A printhead support structure according to claim 1, wherein the second portion is fixed at the edge by the flexure.

3. A printhead support structure according to claim 2, wherein the flexure is arranged such that a translational movement of the first portion along a first axis produces a force on the second portion in a direction perpendicular to the first axis, such that said force causes the second portion to rotate about a second axis parallel to the first axis.

4. A printhead support structure according to claim 3, wherein the second portion is coupled to the printhead such that the rotational movement of the second portion about a second axis provides a rotational movement of the printhead about an axis parallel to the second axis.

5. A printhead support structure according to claim 4, wherein the flexure comprises a pair of opposed flexure points with a diagonal linkage.

6. A printhead support structure according to claim 5, wherein the printhead has an array of a plurality of nozzles and wherein the rotational movement of the printhead is in the plane of the array of nozzles.

7. A printhead support structure according to claim 1, wherein the flexure is formed within the body of the printhead support structure.

8. A printhead support structure according to claim 1, wherein the printhead support structure retains the printhead in a fixed position after adjustment without an additional locking mechanism.

9. A printhead support structure according to claim 1, wherein the second portion is fixed at a first edge, such that a second edge of the second portion, opposed to the first edge, is constrained to rotate about the first edge; and wherein the flexure is arranged to provide a reduction ratio such that the magnitude of the translational movement of the second edge of the second portion and the magnitude of the translational movement of the first portion are in a ratio of less than one.

10. A printhead support structure according to claim 1, further comprising an adjuster screw arranged such that rotation of the adjuster screw provides said translational movement of the first portion.

11. A printhead support structure according to claim 1, wherein the printhead adjustment is actuated from a direction parallel to the axis of rotation of the printhead.

12. A printhead support structure according to claim 1, further operable to provide a translational movement of the print-head.

13. A printhead support structure according to claim 1, further comprising:

a motor for effecting translational movement of the first portion.

14. A print assembly comprising:

an array of a plurality of printheads arranged in a plane; and a printhead support structure according to claim 1 for each of said plurality of printheads for adjusting the position of each printhead;

wherein each printhead adjustment is actuated from a direction perpendicular to the plane of the printhead array.

15. A method for adjusting the position of a printhead coupled to a printhead support, comprising the steps of:

applying a force to a first portion of the printhead support to effect a translational movement of the first portion, wherein the translational movement is substantially along a first axis;

converting said translational movement of the first portion into a rotational movement of a second portion of the printhead support by fixing the second portion at an edge, such that the second portion is constrained to rotate about a second axis parallel to the first axis; and applying said rotational movement of the second portion to the printhead.

16. A method for adjusting the position of a printhead according to claim 15, wherein said method further comprises the step of:

retaining the printhead in a fixed position after applying said rotational movement to the printhead without locking.

17. A method for adjusting the position of a printhead according to claim 15, further comprising the step of:

providing a translational movement of the printhead in a cross-process direction, wherein said translational movement of the printhead in the cross-process direction is calculated to compensate for the rotational movement applied to the printhead.

18. A method for adjusting the position of a printhead according to claim 17, wherein:

said compensation for the rotational movement alters the effective axis of rotation of the printhead.

* * * * *